US006758191B2

(12) United States Patent
Vanderveen et al.

(10) Patent No.: US 6,758,191 B2
(45) Date of Patent: Jul. 6, 2004

(54) VEHICLE INTAKE MANIFOLD HAVING AN INTEGRATED FUEL RAIL AND VOLUME ADJACENT THERETO

(75) Inventors: James K. Vanderveen, Blehelm (CA); Ki-Ho Lee, Windsor (CA)

(73) Assignee: Siemens VDO Automotive Inc., Chatham, CA (US)

( * ) Notice: Subject to any disclaimer, the term of this patent is extended or adjusted under 35 U.S.C. 154(b) by 0 days.

(21) Appl. No.: 10/439,523

(22) Filed: May 16, 2003

(65) Prior Publication Data

US 2003/0230286 A1 Dec. 18, 2003

Related U.S. Application Data

(60) Provisional application No. 60/389,582, filed on Jun. 18, 2002, provisional application No. 60/389,595, filed on Jun. 18, 2002, and provisional application No. 60/389,824, filed on Jun. 19, 2002.

(51) Int. Cl.[7] ..... F02M 35/10; F02M 55/02

(52) U.S. Cl. ..... 123/456; 123/468; 123/516; 123/184.47; 123/184.61

(58) Field of Search ..... 123/456, 468, 123/470, 516, 198 D, 184.21, 184.34, 184.42, 184.47, 184.61

(56) References Cited

U.S. PATENT DOCUMENTS

| | | | | |
|---|---|---|---|---|
| 4,776,313 A | * | 10/1988 | Freismuth et al. | 123/470 |
| 5,163,406 A | * | 11/1992 | Daly et al. | 123/456 |
| 5,533,485 A | * | 7/1996 | Bronkal | 123/456 |
| 5,682,859 A | * | 11/1997 | Wakeman | 123/470 |
| 5,771,863 A | * | 6/1998 | Daly | 123/456 |
| 6,186,106 B1 | * | 2/2001 | Glovatsky et al. | 123/143 C |
| 6,308,686 B1 | * | 10/2001 | Mammarella et al. | 123/470 |

* cited by examiner

*Primary Examiner*—Weilun Lo

(57) ABSTRACT

An intake manifold (10) includes an integral fuel rail (14) at least partially surrounded by a volume (22). The volume (22), being adjacent the fuel rail (14), minimizes the permeation of fuel out of the fuel rail (14). The volume (22) is also utilizable as a sealed storage space to contain an air induction component (26) to more effectively utilize the packaging space of the intake manifold (10).

7 Claims, 2 Drawing Sheets

VEHICLE INTAKE MANIFOLD HAVING AN INTEGRATED FUEL RAIL AND VOLUME ADJACENT THERETO

The present application claims priority to U.S. Provisional Patent Application Serial Nos. 60/389,582 and 60/389,595, both filed Jun. 18, 2002 and U.S. Provisional Patent Application Serial No. 60/389,824 filed Jun. 19, 2002.

BACKGROUND OF THE INVENTION

The present invention relates to a non-metallic vehicle air intake manifold and, more particularly, to an intake manifold which integrates a fuel rail and adjacent volume within the heretofore unused space within the intake manifold.

An air intake manifold distributes air to a vehicle engine's cylinders. The manifold is located on the engine in the engine compartment of a vehicle. The manifold is in close proximity to various electrical components of the vehicle engine such as fuel injectors, electric throttle body, throttle position sensors, idle air controller, and air temperature and pressure sensors. Other components are also located within the engine compartment such as fuel rails, air cleaners and other air induction components.

The intake manifold primarily includes a plurality of runners which communicate and distribute air to the engine cylinders. The runners are of a particular geometry to assure proper air flow thereto. One of the major factors that influences engine performance as determined by the air intake manifold, is the air flow runner length and their sectional area. Recently, non-metallic materials are used in the manufacture of air intake manifolds. The intake manifolds are manufactured separate from the fuel rail as the fuel rail is commonly manufactured of metal to minimize permeation of fuel therefrom.

The intake manifold is often shaped to accommodate the fuel rail location while assuring proper air flow to the engine cylinders and precise fuel delivery. The intake manifold may therefore be relatively large in size and include numerous components, such as sensors, actuators, wiring harness and associated fasteners. The relatively large air intake manifold, combined with the numerous associated components, provides a rather complicated molded and time consuming multiple assembly process. Moreover, the engine compartment must therefore be designed to accommodate these numerous, rather large components. This may disadvantageously limit the desired design of the vehicle and increase labor cost and cycle time.

Accordingly, it is desirable to provide an air intake manifold which integrate multiple airflow related components without minimizing the air distributing capabilities thereof.

SUMMARY OF THE INVENTION

The intake manifold according to the present invention provides an integral fuel rail at least partially surrounded by a volume. The volume, being adjacent the fuel rail, minimizes the permeation of fuel out of the fuel rail. That is, the fuel must not only permeate through a surface of the fuel rail, but must additionally permeate a surface which defines the volume to fully escape the intake manifold. Manufacture of the fuel rail as integral to the non-metallic intake manifold with minimization of fuel escape through permeation is therefore advantageously provided by the present invention.

Another intake manifold assembly utilizes the volume as a sealed storage space. The volume may alternatively or additionally be utilized to contain an air induction component such as an acoustic resonator, charcoal canister, air cleaner, or the like which has heretofore been located adjacent the intake manifold.

The present invention therefore provides an air intake manifold which integrate multiple airflow related components without minimizing the air distributing capabilities thereof.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
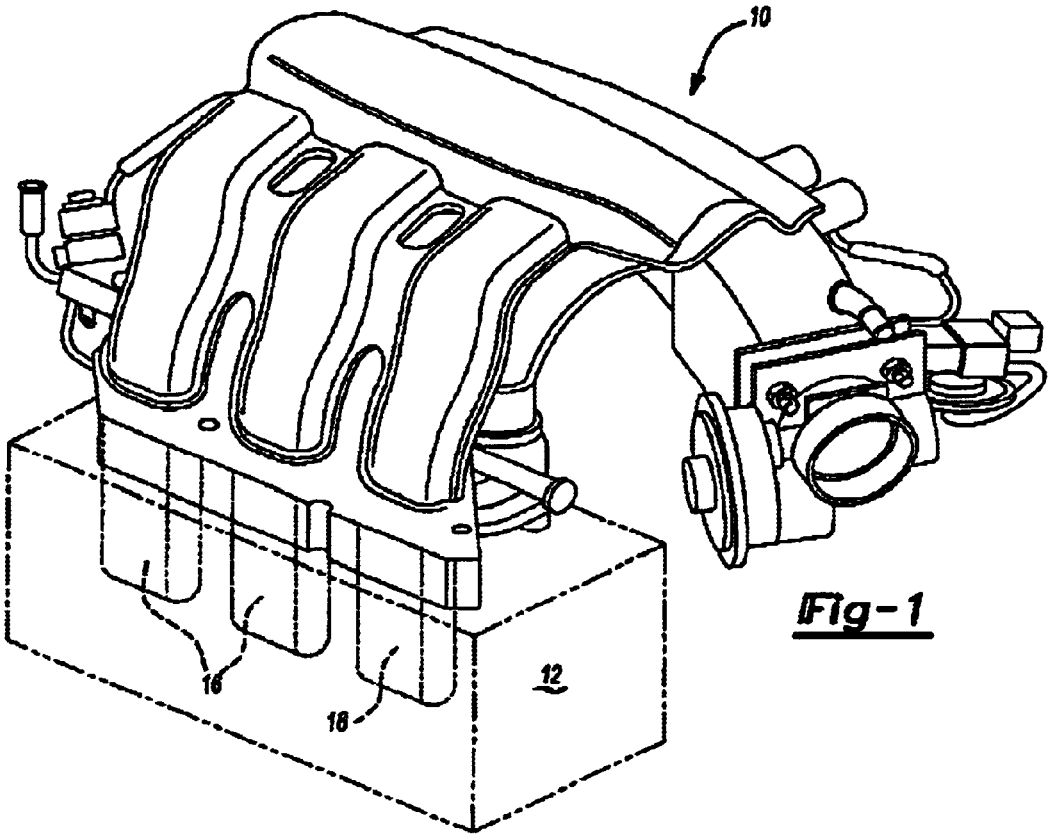
FIG. 1 is a general perspective view an intake manifold for use with the present invention.
Figure 2:
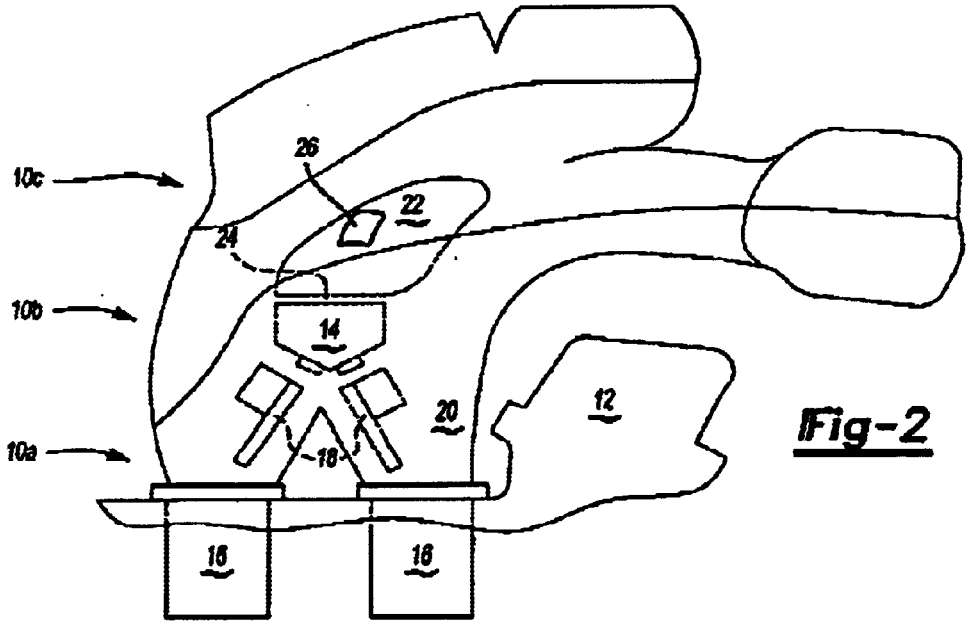
FIG. 2 is a general sectional view of the intake manifold of FIG. 1.

FIG. 1 illustrates a general perspective view of an intake manifold assembly 10 mounted to an internal combustion engine (illustrated schematically at 12) to provide for regulation of an air fuel mixture. The manifold is preferably a non-metallic molded plastic manifold, which is manufactured of a plurality of sections 10*a*, 10*b*, 10*c* (FIG. 2). It should be understood that any number of sections and interface locations will benefit from the present invention.

Figure 3:
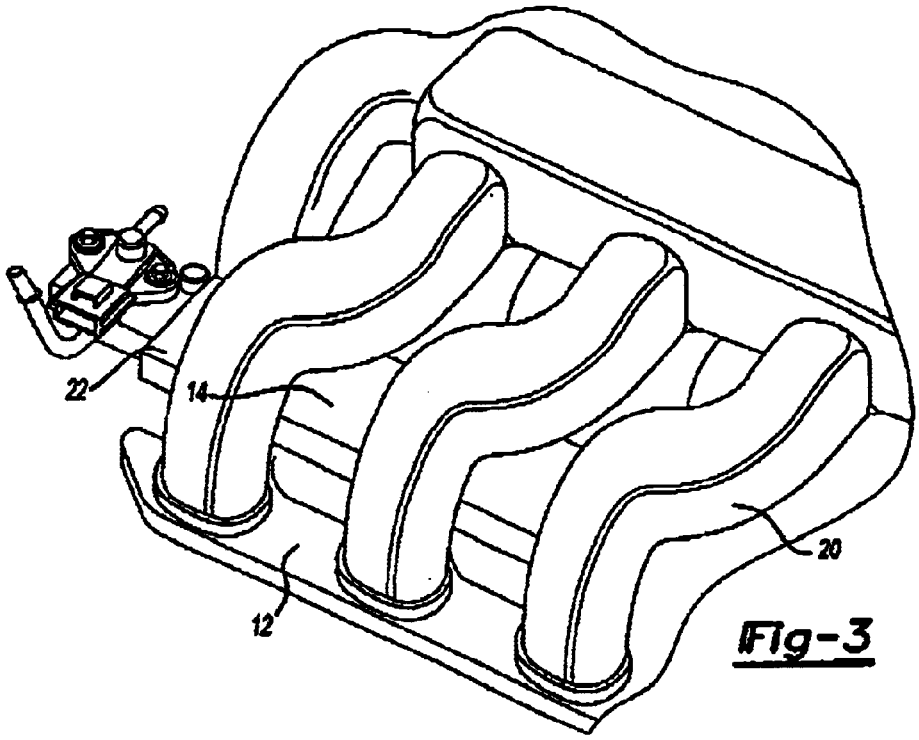
FIG. 3 is a general perspective view of the intake manifold of the present invention.
Figure 4:
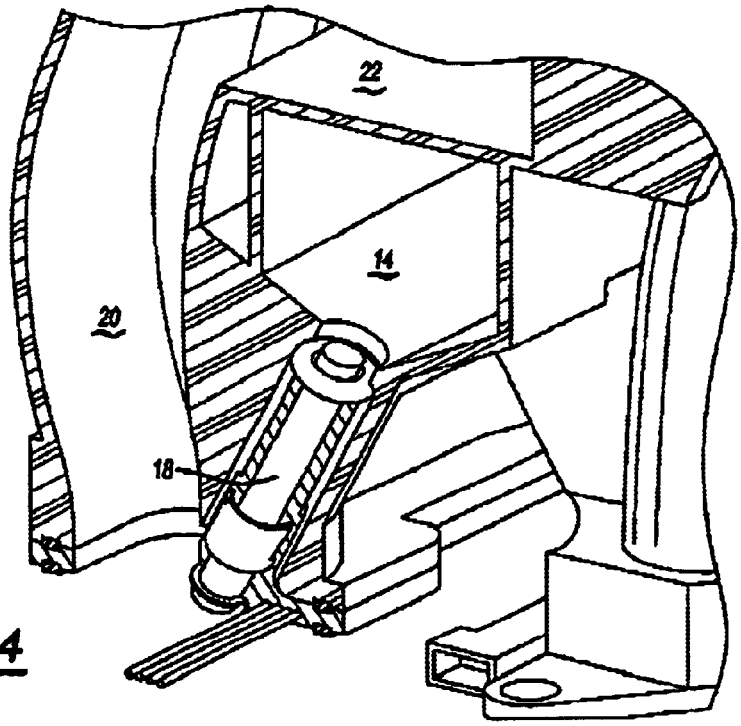
FIG. 4 is a sectional view of the fuel rail of the present invention illustrating the interface between the fuel rail and a plurality of fuel injectors.

Referring to FIG. 2, the intake manifold 10 includes a fuel rail 14 which is preferably directly molded therein. That is, the fuel rail 14 is integrally molded into the intake manifold 10 (FIG. 3) and forms a portion thereof. The fuel rail 14 is preferably pentagonal in cross-sectional shape; however, other shapes will benefit from the present invention. The fuel rail 14 communicates with each of a plurality of engine cylinders (illustrated schematically at 16) through a fuel injector 18. Fuel fills the fuel rail and is communicated into each engine cylinder 16 through operation of the fuel injectors 18 (also illustrated in FIG. 4). The fuel injectors 18 regulate the amount of fuel mixed with air drawn through the intake manifold 10 and into the engine 12. A runner 20 communicates the airflow to each engine cylinder 16 within the engine 12.

Adjacent the fuel rail 14 is a volume 22. The volume 22 is integrally molded into the intake manifold 10 and forms a portion thereof. The volume 22 is located at least above the fuel rail 14, however, any number of volumes either continuous or discontinuous will benefit from the present invention. Although preferably located above, the volume 22 may alternatively or additionally surround any side and/or portion of the fuel rail 14. It should be understood that relative positional terms such as "forward," "aft," "upper," "lower," "above," "below," and the like are with reference to the normal operational attitude of the vehicle and should not be considered otherwise limiting.

The volume 22, being adjacent the fuel rail 14, minimizes the permeation of fuel out of the fuel rail 14. That is, the fuel must not only permeate through a surface 24 between the fuel rail 14 and the volume 22, but must additionally permeate a surface which defines the volume 22. Manufacture of the fuel rail 14 as integral to the non-metallic intake manifold 10 with minimization of fuel escape through permeation is therefore advantageously provided by the present invention.

Preferably, the volume 22 is sealed and may therefore be utilized as a storage space. In addition to minimizing permeation, the volume 22 may alternatively or additionally be utilized to contain an air induction component 26 such as an acoustic resonator, charcoal canister, air cleaner, or the like which has heretofore been located adjacent the intake manifold. A more compact arrangement is therefore provided as the space of the intake manifold is more effectively utilized.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason, the following claims should be studied to determine the true scope and content of this invention.

What is claimed is:

1. A non-metallic intake manifold assembly comprising:

an intake manifold comprising a plurality of runners, said intake manifold formed of a non-metallic material said intake manifold defining an empty volume formed within said intake manifold and separate from said plurality of runners; and a fuel rail integrally formed within said intake manifold adjacent and separate from said empty volume, said fuel rail formed of said non-metallic material.

2. The intake manifold as recited in claim 1, wherein said fuel rail is adjacent each of said plurality of runners.

3. The intake manifold as recited in claim 1, wherein said fuel rail is pentagonal in cross-section.

4. The intake manifold as recited in claim 1, further comprising a plurality of fuel injectors in communication with said fuel rail.

5. The intake manifold as recited in claim 1, wherein said empty volume comprises an air induction component.

6. The intake manifold as recited in claim 1, wherein said empty volume shares a wall with said fuel rail.

7. The intake manifold as recited in claim 1, wherein said empty volume is formed above said fuel rail.

* * * * *